United States Patent [19]

Pichette

[11] 4,226,059

[45] Oct. 7, 1980

[54] ATTACHING DEVICE FOR SOFFITS

[76] Inventor: Carold Pichette, 163 de l'Eglise St., Château Richer, Canada, G0A 1N0

[21] Appl. No.: 959,332

[22] Filed: Nov. 9, 1978

[51] Int. Cl.[2] ..... E04B 7/00

[52] U.S. Cl. ..... 52/94; 52/60

[58] Field of Search ..... 52/94, 242, 60

[56] References Cited

U.S. PATENT DOCUMENTS

| | | | |
|---|---|---|---|
| 2,682,087 | 6/1954 | Siering | 52/242 |
| 3,135,070 | 6/1964 | Waring | 52/94 |
| 3,181,275 | 5/1965 | Schroter | 52/94 |
| 3,344,566 | 10/1967 | Miles | 52/94 |
| 3,685,227 | 8/1972 | Grisard | 52/242 |
| 4,151,691 | 5/1979 | Wendt | 52/242 |

*Primary Examiner*—Price C. Paw, Jr.
*Assistant Examiner*—Henry E. Raduazo

[57] ABSTRACT

An attaching device to secure soffits under the eaves of a roof and to cover their ends. The attaching device is made of two separate pieces with snap action interlocking means. A top piece is first secured to the eaves and, once the soffit is fitted and retained to the eaves, the bottom piece is interlocked with the top piece. The bottom piece has a plate part extending under the soffit. The same attaching device may be used to secure sidings on the outside walls of buildings.

3 Claims, 2 Drawing Figures

ATTACHING DEVICE FOR SOFFITS

Figures 1, 2:
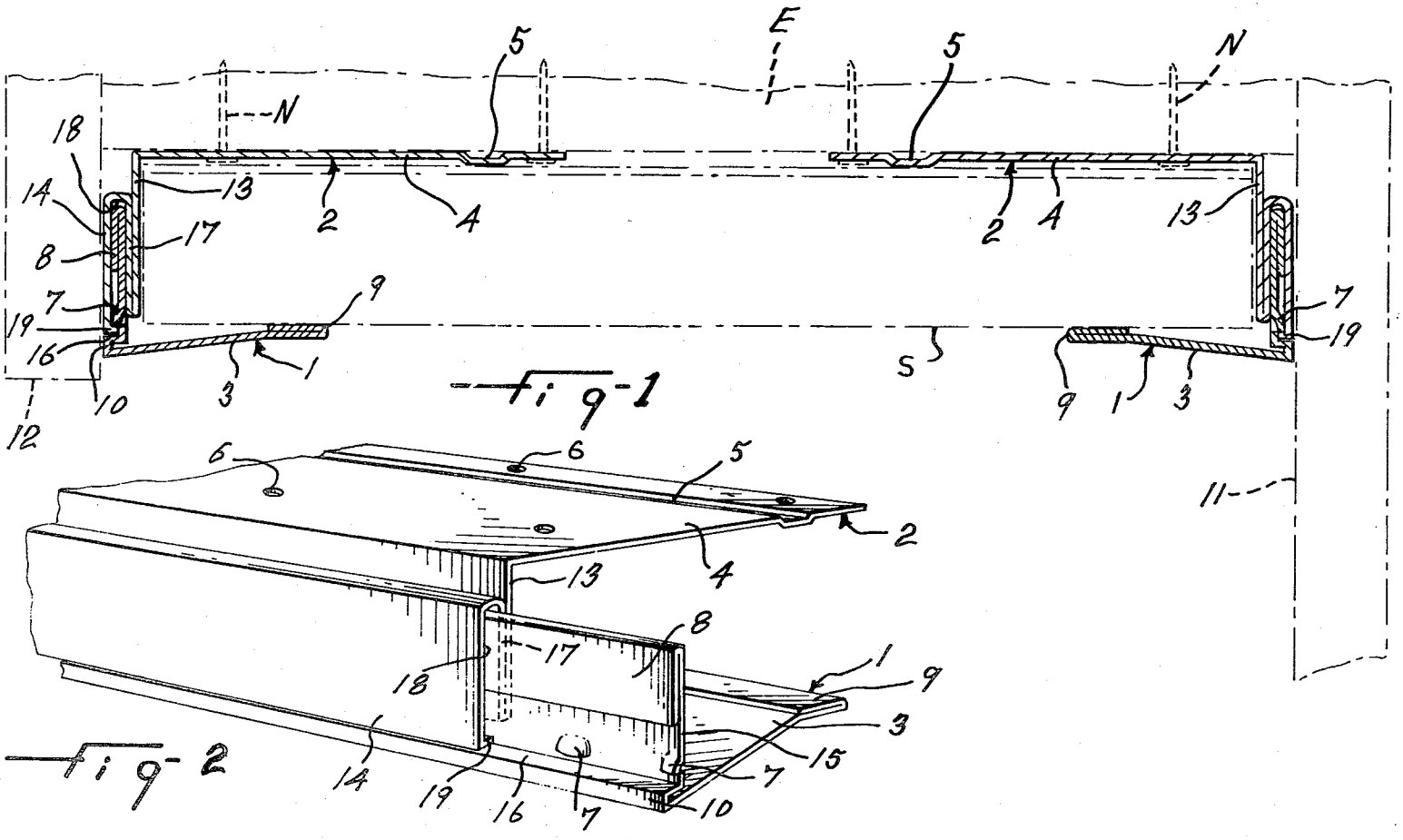

This invention relates to attaching means for soffits under the eaves of a roof, and more particularly to the attaching means known in the trade as G-trim, so-called because of its general shape.

The installation of soffits, or special panels, provided for the purpose of ventilation under eaves is usually difficult, as the conventional supporting G-trim, which is made in one piece, has to be secured to the eaves in a permanent manner (by means of nails, for example). Once the G-trim is in place, the soffit must necessarily be wedged and angled in as the dimensions and space of the eaves allow, a task which is often time-consuming and laborious.

The present invention introduces G-trim in two pieces whereby installation of a soffit is greatly facilitated.

It is therefore an object of the present invention to provide a G-trim easily attachable to eaves by a conventional method.

It is another object of the present invention to provide a G-trim wherein a top piece of the G-trim is firstly secured to the eaves; and afterwards, a bottom piece for supporting a soffit is fitted to the first piece simply and permanently, thus eliminating the need to manoeuver the soffit into position.

It is a further object of the present invention to provide a G-trim which may be inexpensively manufactured.

The G-trim according to the present invention comprises a top piece which includes a flat plate provided with holes in its surface for receiving nails or screws to secure the flat plate to a generally horizontal support and a flange projecting downwards at a right angle to the plate, a bottom piece which includes a flat soffit-supporting plate adapted to be positioned in a generally horizontal plane, and a vertical flange projecting upwardly from the soffit-supporting plate, together with snap means for attaching together the flanges of the two flat plates.

To proceed with the installation of a soffit, two top pieces are nailed or screwed to the eaves adjacent to the wall of the building and adjacent to the overhang of the roof, respectively. Soffits 10 are nailed to eaves 10 in position between the two top pieces. Then the bottom pieces of the G-trims are attached to the top pieces respectively to extend underneath the soffits.

The present invention will be more clearly understood by referral to a preferred embodiment thereof illustrated by way of the accompanying drawings, in which:

FIG. 1 is a cross-sectional view of two assembled G-trims installed under an eaves and supporting a soffit shown in dot-and-dash lines; and FIG. 2 is a partially sectioned perspective view of the G-trim showing the bottom piece not completely in place for more clearly showing its structure.

The G-trim consists of a bottom piece 1, made of resilient material, preferably sheet metal, having a flat plate 3 inclined at a slight angle above the horizontal and a vertical flange 15 projecting upwardly from plate 3. Bottom piece 1 is provided with a horizontal lip 9 formed by a portion of flat plate 3 bent back upon itself. The outer edge 10 of bottom piece 1 is bent back upon itself at two successive 90-degree angles, thus forming a flat lengthwise extending ledge 16. A flange 15 is formed by bending bottom piece 1, so that flange 15 is vertical and upwardly extending. Flange 15 is bent back upon itself 180 degrees, as shown at 8, forming thus an upper portion of flange 15 which is twice as thick as the lower portion of the flange 15. The lower outside face of flange 15 is provided with a plurality of longitudinally spaced-apart punched-out indentations 7.

Bottom piece 1 of the present G-trim is complemented by a top piece 2, also made of resilient material, preferably sheet metal, and consisting of a flat plate 4 and a flange 13 extending downwardly at right angles to flat plate 4. Plate 4 has a lengthwise extending corrugation 5 added to strengthen the plate. Plate 4 also has holes 6 for nails N, or screws for attachment to the eaves E, as shown by FIG. 1.

A flange 13 projects downward from the outside edge of plate 4 and is bent back upon itself at a 180-degree angle, so that a portion 17 is flush with the outside surface of flange 13. Portion 17 is bent back upon itself toward the outside at an angle of 180 degrees, thus forming a second flange 14 such that an inverted U-shaped slot 18 is formed between portion 17 and flange 14. The bottom edge of flange 14 is bent inward to make a lengthwise extending tab 19.

To install a soffit 10, two top pieces 2 of the G-trims are first attached to the eaves by means of nails N or screws, one top piece being installed with the outer face of flange 14 flush with the wall 11 of a building or house (shown in dot-and-dash outline in FIG. 1), and the other top piece having its flange 14 flush with an overhang 12 (also shown outlined in FIG. 1) of the eaves. Once the two top pieces are in place, soffits 10 can be fitted therebetween and nailed in position to eaves E. The two bottom pieces can then be fitted next. This is done by sliding flange 15 upwardly into U-shaped slot 18. Tab 19 slides along the upwardly facing inclined portion of indentations 7 and fits underneath said punched-out indentations 7 with a snap action. Flange 13 and portion 17 together constitute a thickness which fits tightly in U-shaped slots 18, as shown by FIG. 1, and indentations 7 provide a force-fit against the inside surface of flange 14 and overlap tab 19. Once a bottom piece 1 is thus in place, it is permanently secured.

The ends of soffit 10 are covered by the bottom pieces 1 with flat plates 3 resiliently engaging the bottom surface of the soffit.

Ledge 10 masks the snap connection of indentations 7 with tab 19 and provides a neat finish. Clearly the G-trim according to the present invention is easy to install.

The end of soffit 10 cannot mask U-shaped slot 18 during installation, since it abuts against flange 13. Therefore, slot 18 remains clear to receive flange 15 of bottom piece 1. Since indentations 7 are spaced apart longitudinally of bottom piece 1, a long such piece 1 can be progressively snapped into attached position during installation of successive soffit panels S.

What I claim is:

1. An attaching device to secure soffits to the eaves of a roof or to attach other covering panels to a support, including a first piece and a second piece, each made of an elastic sheet material, each having a profile generally in the shape of the letter L and characterized by a first branch and a second branch, the second branches being attachable one to the other by overlapping, the first branches extending in the same direction relative to the second branches when the latter are attached such that the joint has a profile in the shape of the letter U, the second branch of the said first piece being provided at its outer edge with an extension folded back twice to form two U-configurations disposed side by side on the outside of said last-named second branch, the U-configurations next to said last-named second branch opening towards said first branch of said first piece and the other U-configuration opening in a direction opposed to the first branch of this first piece, said other U-configuration defining a space, the longitudinal axis of which is substantially parallel to the said second branch of the first piece, whereby the second branch of the said second piece may be inserted into said space up to a limit position; a shelf formed at the free edge of said other U-configuration and partially masking the opening of said space, and longitudinally spaced-apart teeth formed on the second branch of said second piece and engaging said shelf with a snap action in the limit position of said second branch of said second piece, said shelf and teeth cooperatively maintaining the engagement of the said second branches and preventing their disengagement once the limit position is attained, the first branch of said first piece having means to secure the same to a support which is to be covered by a panel, the first branch of the second piece serving as a covering branch for the end of said panel, and the second branch of said first piece extending across the end of said panel and serving as a stop for said panel to keep said panel out of the way of said space.

2. An attaching device as claimed in claim 1, wherein said second branch of said second piece forms an outward shoulder spaced from said teeth and located intermediate said teeth and the first branch of said second piece, said shoulder covering said shelf in the attached position of the two said pieces.

3. An attaching device as claimed in claim 1 or 2, wherein the two branches of the second piece, the first branch of which serves as a covering branch, form a slightly acute angle between them.

* * * * *